US009274471B2

(12) United States Patent
Higashiyama et al.

(10) Patent No.: US 9,274,471 B2
(45) Date of Patent: Mar. 1, 2016

(54) ROTATABLE HEATING MEMBER AND IMAGE HEATING APPARATUS

(71) Applicant: CANON KABUSHIKI KAISHA, Tokyo (JP)

(72) Inventors: Taku Higashiyama, Yokohama (JP); Koji Inoue, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/602,881

(22) Filed: Jan. 22, 2015

(65) Prior Publication Data

US 2015/0212460 A1 Jul. 30, 2015

(30) Foreign Application Priority Data

Jan. 24, 2014 (JP) ..... 2014-010907

(51) Int. Cl.
*G03G 15/20* (2006.01)

(52) U.S. Cl.
CPC ..... *G03G 15/206* (2013.01); *G03G 15/2057* (2013.01)

(58) Field of Classification Search
CPC ..... G03G 15/2057; G03G 15/206
USPC ..... 399/333
See application file for complete search history.

(56) References Cited

U.S. PATENT DOCUMENTS

2008/0273904 A1* 11/2008 Nishida et al. ..... 399/333
2013/0016986 A1* 1/2013 Kim et al. ..... 399/44
2014/0301762 A1* 10/2014 Inoue et al. ..... 399/333

FOREIGN PATENT DOCUMENTS

JP 2009-63723 A 3/2009
JP 2009063723 A * 3/2009

OTHER PUBLICATIONS

Katsuhiko Kanari, "Thermal Conductivity of High Polymer Materials," 176 Circulars of the Electrotechnical Laboratory 32-45 (Dec. 1973).
Guest Paper, Nikkei Electronics, pp. 132-133 (Dec. 2002).

* cited by examiner

*Primary Examiner* — David Gray
*Assistant Examiner* — Tyler Hardman
(74) *Attorney, Agent, or Firm* — Fitzpatrick, Cella, Harper & Scinto

(57) ABSTRACT

A rotatable heating member incorporating a heat source configured to heat a toner image on a sheet includes an elastic layer and a surface layer provided on the elastic layer. When thermal effusivity of the surface layer is Bs and thermal effusivity of the elastic layer is Be, the following relationship is satisfied:

$$-0.04<(Be-Bs)/Be<0.04.$$

15 Claims, 8 Drawing Sheets

(a) (b)

ROTATABLE HEATING MEMBER AND IMAGE HEATING APPARATUS

FIELD OF THE INVENTION AND RELATED ART

The present invention relates to a rotatable heating member for heating a toner image on a sheet, and an image heating apparatus including the rotatable heating member.

In a conventional electrophotographic image forming apparatus, the toner image formed on the sheet (recording material) is heated and pressed by a fixing device (image heating apparatus), and thus is fixed on the sheet. The fixing device has a constitution in which the toner image is heated and pressed in a nip formed by a pair of rotatable members. Of the pair of rotatable members, a heating member (rotatable heating member) incorporating a heat source includes a surface layer (also referred to as a parting layer) and an elastic layer under the surface layer.

The elastic layer is considerably thicker than the parting layer, and therefore most of a thermal resistance of the heating member is caused by thermal resistivity of the elastic layer. When the thermal resistance of the heating member is large, a degree of a lowering in surface temperature becomes large, and therefore the thermal conductivity of the elastic layer may preferably be low. Therefore, a filler, such as alumina having high thermal conductivity, is dispersed in a rubber material forming the elastic layer to increase the thermal conductivity of the material (Japanese Laid-Open Patent Application (JP-A) 2009-6372, "Thermal Conductivity of High Polymer Materials" of the Circulars of the Electrotechnical Laboratory, vol. 176, pp. 32-45).

A method of obtaining the thermal conductivity of a material layer in the case where the filler having the high thermal conductivity is dispersed in the polymeric material layer having low thermal conductivity is described in this Circulars of the Electrotechnical Laboratory publication. JP-A 2009-63723 discloses that when the thermal conductivity of the elastic layer is increased by dispersing the filler in the elastic layer, uneven glossiness of a fixed image can be alleviated by making a filler density in a shallow region, adjacent to the parting layer of the elastic layer, smaller than that in a deep region.

In Nikkei Electronics (2002 Dec. 16, page 132), an experimental result such that the thermal conductivity of the parting layer was increased to twice the original thermal conductivity by adding $Al_2O_3$ as the filler into the material forming the parting layer in a volume function of 30% is described.

In the case where the parting layer is disposed on a surface of the elastic layer in which the filler having high thermal conductivity is dispersed, it was turned out that even when uniform fixing is made over an entire surface of the heating member in a brand-new condition, the uneven glossiness is liable to generate on an output image when a lifetime of the heating member reaches an end thereof. It would be considered that this is because the parting layer is gradually abraded (worn) with accumulation of image formation to becomes thin. Further, it would be considered that this is because a degree of an advance of abrasion of the parting layer is different depending on a longitudinal position of the heating member and when a difference in thermal conductivity between the elastic layer and the parting layer is large, a surface temperature distribution of the heating member largely varies.

SUMMARY OF THE INVENTION

According to an aspect of the present invention, there is provided a rotatable heating member incorporating a heat source configured to heat a toner image on a sheet, comprising: an elastic layer; and a surface layer provided on the elastic layer, wherein when thermal effusivity of the surface layer is Bs and thermal effusivity of the elastic layer is Be, the following relationship is satisfied:

$$-0.04<(Be-Bs)/Be<0.04.$$

According to another aspect of the present invention, there is provided a rotatable heating member incorporating a heat source configured to heat a toner image on a sheet, comprising: a metal layer to be heated through electromagnetic induction heating; an elastic layer provided on the metal layer; and a surface layer provided on the elastic layer, wherein when thermal effusivity of the surface layer is Bs and thermal effusivity of the elastic layer is Be, the following relationship is satisfied:

$$-0.04<(Be-Bs)/Be<0.04.$$

According to another aspect of the present invention, there is provided an image heating apparatus comprising: a rotatable heating member configured to heat a toner image on a sheet, wherein the rotatable heating member includes an elastic layer and a surface layer provided on the elastic layer; and a heating mechanism configured to heat the rotatable heating member from an inside of the rotatable heating member, wherein when thermal effusivity of the surface layer is Bs and thermal effusivity of the elastic layer is Be, the following relationship is satisfied:

$$-0.04<(Be-Bs)/Be<0.04.$$

According to a further aspect of the present invention, there is provided an image heating apparatus comprising: a rotatable heating member configured to heat a toner image on a sheet, wherein the rotatable heating member includes a metal layer, an elastic layer provided on the metal layer, and a surface layer provided on the elastic layer; and a heating mechanism configured to heat the metal layer through electromagnetic induction heating, wherein when thermal effusivity of the surface layer is Bs and thermal effusivity of the elastic layer is Be, the following relationship is satisfied:

$$-0.04<(Be-Bs)/Be<0.04.$$

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Embodiments of the present invention will be described specifically with reference to the drawings.

First Embodiment (Image Forming Apparatus)

Figure 1:
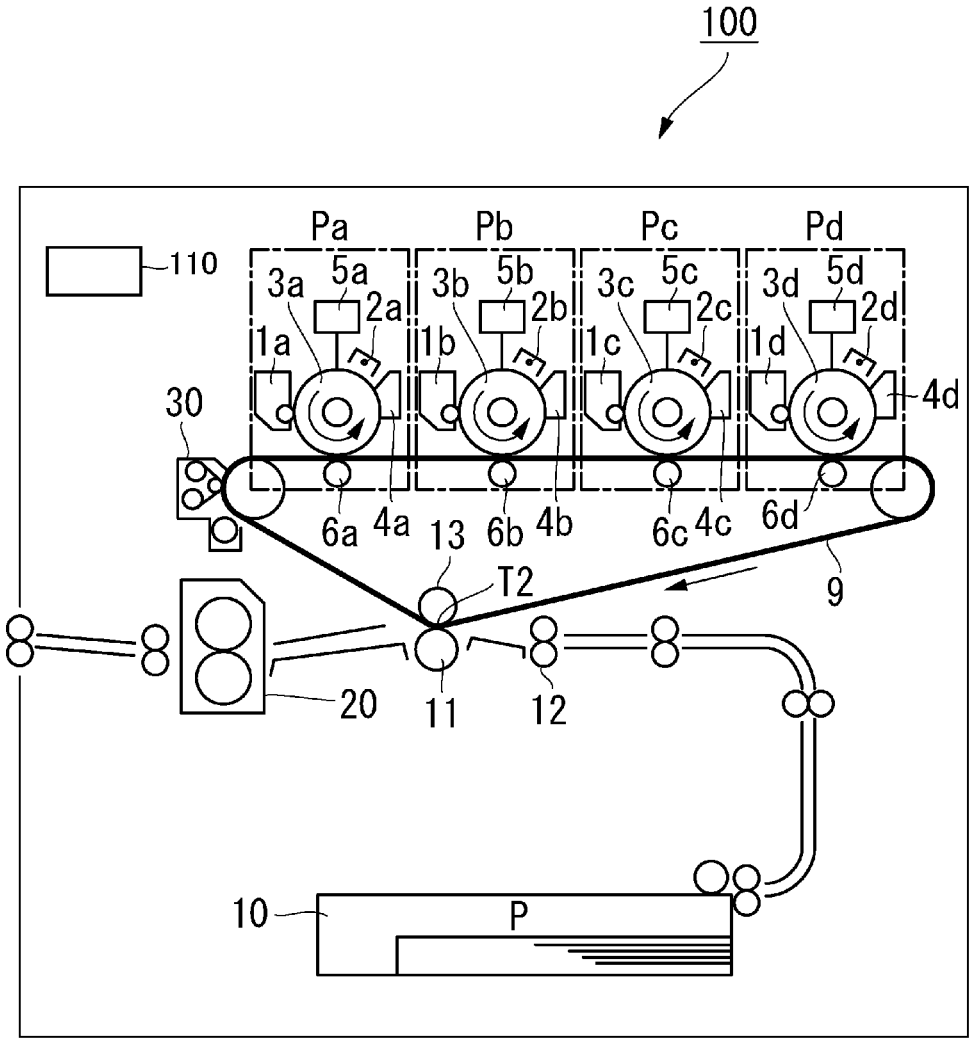
FIG. 1 is an illustration of a structure of an image forming apparatus.

FIG. 1 is an illustration of structure of an image forming apparatus. As shown in FIG. 1, an image forming apparatus 100 in this embodiment is a tandem-type full-color printer of an intermediary transfer type in which image forming portions Pa, Pb, Pc and Pd for yellow, magenta, cyan and black, respectively, are arranged along an intermediary transfer belt 9.

The image forming apparatus 100 operates the image forming portions, Pa, Pb, Pc and Pd on the basis of a color-separation image signal inputted from an external host device connected communicatably with the image forming apparatus 100, and forms and outputs a full-color image on a recording material. The external host device is a computer, an image reader or the like.

In the image forming portion Pa, a yellow toner image is formed on a photosensitive drum 3*a* and then is primary-transferred onto the intermediary transfer belt 9. In the image forming portion Pb, a magenta toner image is formed on a photosensitive drum 3*b* and is primary-transferred onto the intermediary transfer belt 9. In the image forming portions Pc and Pd, a cyan toner image and a black toner image are formed on photosensitive drums 3*c* and 3*d*, respectively, and are primary-transferred successively onto the intermediary transfer belt 9.

A recording material P is taken out from a recording material cassette 10 one by one by and is in stand-by between registration rollers 12. The recording material P is fed by the registration rollers 12 to a secondary transfer portion T2 while being timed to the toner images on the intermediary transfer belt 9. The recording material P on which the toner images are secondary-transferred from the intermediary transfer belt 9 is fed to a fixing device 20. The recording material P is, after being heated and pressed by the fixing device 20 to fix the toner images thereon, discharged to an outside of the image forming apparatus.

The image forming portions Pa, Pb, Pc and Pd have the substantially same constitution except that the colors of toners of yellow, magenta, cyan and black used in developing devices 1*a*, 1*b*, 1*c* and 1*d* are different from each other. In the following description, the image forming portion Pa will be described and other image forming portions Pb, Pc and Pd will be omitted from redundant description.

(Image Forming Portion)

The image forming portion Pa includes the photosensitive drum 3*a* around which a corona charger 2*a*, an exposure device 5*a*, the developing device 1*a*, a primary transfer roller 6*a*, and a drum cleaning device 4*a* are provided. The photosensitive drum 3*a* is prepared by forming a photosensitive layer on the surface of an aluminum cylinder. The corona charger 2*a* electrically charges the surface of the photosensitive drum 3*a* to a uniform potential. The exposure device 5*a* writes (forms) an electrostatic image for an image on the photosensitive drum 3*a* by scanning with a laser beam. The developing device 1*a* develops the electrostatic image to form the toner image on the photosensitive drum 3*a*. The primary transfer roller 6*a* is supplied with a voltage, so that the toner image on the photosensitive drum 3*a* is primary-transferred onto the intermediary transfer belt 9.

A secondary transfer roller 11 contacts the intermediary transfer belt 9 supported by an opposite roller 13 to form a secondary transfer portion T2.

The drum cleaning device 4*a* rubs the photosensitive drum 3*a* with a cleaning blade to collect a transfer residual toner deposited on the photosensitive drum 3*a* without being transferred onto the intermediary transfer belt 9. A belt cleaning device 30 collects a transfer residual toner deposited on the intermediary transfer belt 9 without being transferred onto the recording material P at the secondary transfer portion T2.

(Fixing Device)

Figure 2:
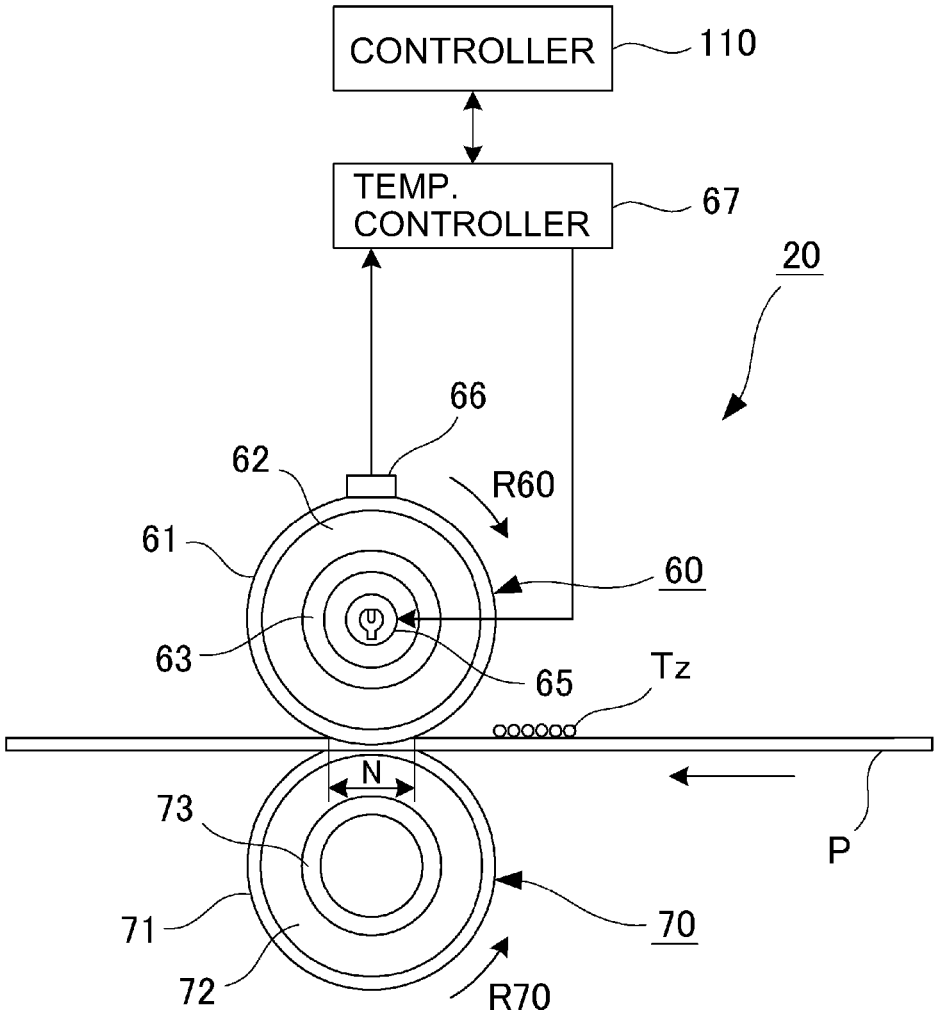
FIG. 2 is an illustration of a structure of a fixing device.

FIG. 2 is an illustration of a structure of the fixing device as an image heating apparatus. As shown in FIG. 2, the fixing device 20 forms a nip N by bringing a pressing roller 70 into contact with a fixing roller 60 as a rotatable heating member. The pressing roller 70 which is an example of a rotatable nip-forming member is contacted to the fixing roller 60 to form the nip N where the recording material P is to be nipped and fed.

The fixing roller 60 is formed in an outer diameter of 30 mm by providing an elastic layer (roller layer) 62 so as to cover an outer peripheral surface of a hollow core metal 63 of stainless steel and then by providing a parting layer (surface layer) 61 so as to cover an outer peripheral surface of the elastic layer 62. The hollow core metal 63 can be formed using also a metal material or the like, such as aluminum or titanium.

The elastic layer 62 is formed in general using a silicone rubber, having a heat-resistant property, for imparting elasticity. The elastic layer 62 includes a sponge texture formed as a foam of the silicone rubber in a thickness of about 200 μm-3 mm so that the elastic layer 62 can follow surface unevenness of the recording material P to press the toner sufficiently against also a recessed portion.

The parting layer 61 is formed in general using, as a material having the heat-resistant property and small surface energy, a fluorine-containing resin material, a silicone resin material or the like in order to improve a parting property between the toner and the fixing roller 60. This is because when the toner remains on the fixing roller 60, the toner is deposited on the recording material again to cause an image defect, and therefore the toner is prevented from remaining on the fixing roller 60.

However, a material for the parting layer 61 is selected by giving high priority to the parting property, and therefore the parting layer 61 has thermal conductivity lower than the elastic layer 62.

An adhesive is provided at each of an interface between the elastic layer 62 and the parting layer 61 of the fixing roller 60 and an interface between the elastic layer 62 and the hollow core metal 63 of the fixing roller 60. However, a thermophysical property value of the adhesive is close to that of the elastic layer and is sufficiently thin compared with the parting layer, and therefore there is substantially no influence as a thermal resistance.

The pressing roller 70 is formed in an outer diameter of 30 mm by providing an elastic layer 72 so as to cover an outer peripheral surface of a core metal 73 of a metal material and then by providing a parting layer 71 *s* as to cover an outer peripheral surface of the elastic layer 72. The core metal 73 is formed of a cylindrical material of aluminum. The elastic layer 72 is formed of a silicone rubber in a thickness of 100-1000 μm. The parting layer 71 is formed of the fluorine-containing resin material.

Inside the hollow core metal 63, a heating member (heat source, heating mechanism) 65 which is a halogen lamp is provided. On the surface of the fixing roller 60, a temperature detecting member 66 using a thermistor is provided in contact with the fixing roller 60. A temperature control circuit 67 carries out energization contact of the heating member 65 by turning on and off the halogen lamp on the basis of a surface temperature of the fixing roller 60 detected by the temperature detecting member 66, and thus maintains the surface temperature of the fixing roller 60 at a desired temperature.

(Relationship Between Toner/Recording Material Interface Temperature and Fixing Property)

Figure 3:
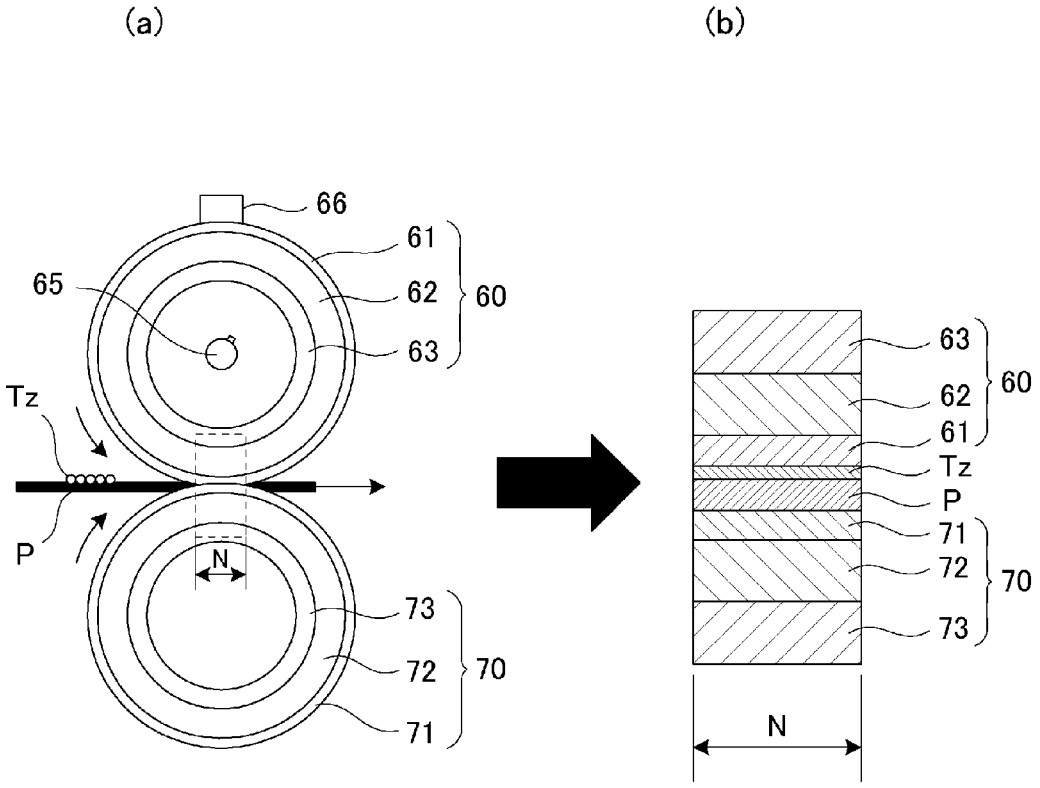
In FIG. 3, (a) and (b) are illustrations of a model of toner heating in the fixing device.
Figure 4:
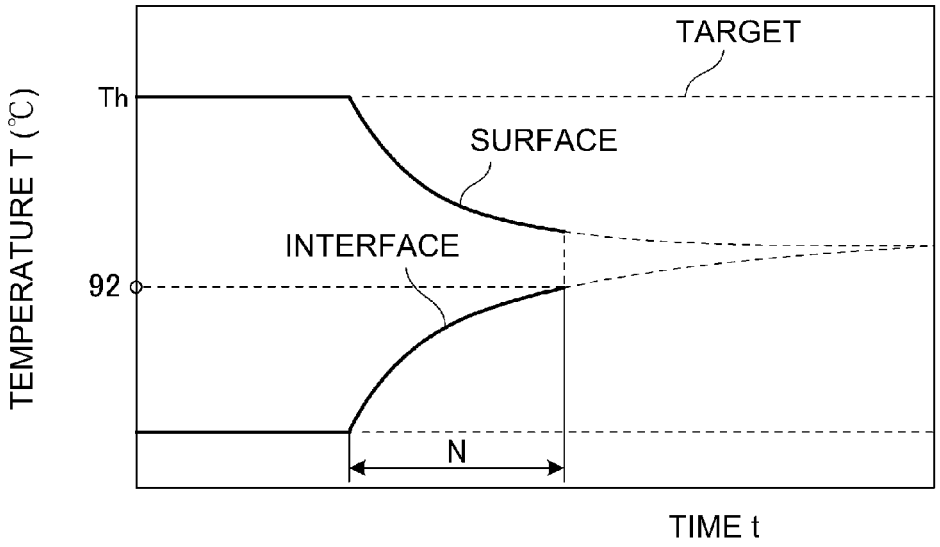
FIG. 4 is an illustration of a change in fixing roller surface temperature when an recording material enters a nip.
Figure 5:
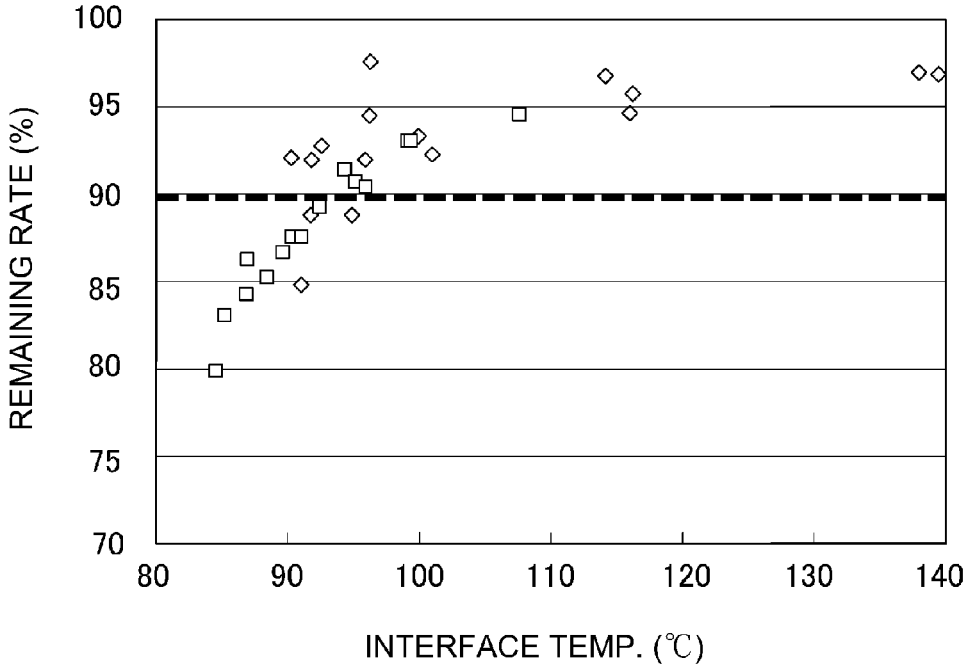
FIG. 5 is an illustration of a relationship between a toner recording material interface temperature and a fixing property.

In FIG. 3, (a) and (b) are illustrations of a model of toner heating in the fixing device. FIG. 4 is an illustration of a change in fixing roller surface temperature when an recording material enters a nip. FIG. 5 is an illustration of a relationship between a toner recording material interface temperature and a fixing property.

As shown in (a) of FIG. 3, in the fixing device 20 of a heating roller type, the heating member is provided inside the hollow core metal 63 of the fixing roller 60, and the elastic layer 62 formed of the material such as the silicone rubber is provided between the hollow core metal 63 and the parting layer 61. Further, when the (unfixed) toner carried on paper as the recording material P passes through the nip N, the elastic layer 62 is deformed along unevenness of the paper surface, so that heat and pressure are uniformly applied to the toner.

As described above, the parting layer 61 of the fixing roller 60 is constituted by giving top priority to the parting property with the toner, and therefore impartment of a high heat-conductive property to the parting layer 61 is not taken into consideration. For that reason, in general, the thermal conductivity of the fluorine-containing resin material used for the parting layer 61 is low compared with the thermal conductivity of the elastic layer 62.

Further, when the thermal conductivity of the parting layer 61 is largely different from the thermal conductivity of the elastic layer 62, depending on a difference in thickness of the parting layer 61, a manner of exhibition of a heat-conductive characteristic of the elastic layer 62 disposed inside the parting layer 61 varies. For this reason, a variation in thermal resistance generates every place of the surface of the fixing roller 60, so that a variation in surface temperature of the fixing roller 60 generates when the fixing roller 60 contacts a cool recording material P. That is, there is a possibility that it is impossible to uniformly control the surface temperature of the fixing roller 60 when only heat conduction of the elastic layer 62 is taken into consideration, and thus the first defect generates in a fixing process.

As shown in FIG. 4, the surface temperature of the fixing roller 60 temperature-adjusted to a surface temperature Th lowers exponentially when the fixing roller 60 contacts the recording material in the nip N. On the other hand, an interface temperature between the paper and the toner increases exponentially by heating of the toner particles contacting the fixing roller 60, but the toner particles have passed through the nip N in a stage long before the temperature thereof reaches the surface temperature of the fixing roller 60, and therefore the toner particles are thereafter cooled by ambient air to lower in temperature. In the case where a step in which the toner is sufficiently melted and fixed on the paper is considered in order to predict the toner image fixing property in such a heating process, it is easily assumed that the paper/toner interface temperature is corrected with the fixing property.

Therefore, many image samples heated up to different paper/toner interface temperatures in the N in actuality were prepared by fixing the toner images on the recording materials while changing the target temperature and the feeding speed in temperature adjustment of the fixing roller 60 of the fixing device 20. With respect to each of the image samples, a half-tone image having a toner amount per unit area of 0.6 ($mg/cm^2$) was formed on plain paper. Then, the fixing property was evaluated based on an anti-wearing property of the fixed image of each of the image samples, so that a relationship between the paper/toner interface temperature and the fixing property was checked.

The paper/toner interface temperatures of the image samples plotted in FIG. 5 are values obtained through calculation by setting a one-dimension model of heat conduction as shown in (b) of FIG. 3. Each of the values represents the paper/toner interface temperature at a point on the paper/toner interface reaching an exit of the nip N while being heated during passing through the nip N at the target temperature and the feeding speed for temperature adjustment of the fixing roller 60. Physical property values of the respective members used for calculation are shown in Table 1.

TABLE 1

| MEMBER | | TH*1 [μm] | TC*2 λ [W/mK] | THC*3 ρC [$J/m^2K$] | TE*4 B [$J/m^2Ks^{0.5}$] |
|---|---|---|---|---|---|
| FR*5 | BM*6 | 1000 | 90 | $4.0 \times 10^6$ | 18974 |
| | EL*7 | 200 | 0.3 | $1.86 \times 10^6$ | 747 |
| | PL*8 | 50 | 0.2 | $2.0 \times 10^6$ | 632 |
| T*9 | — | 5 | 0.3 | $1.8 \times 10^6$ | 735 |
| Rm*10 | PA*11 | 115 | 0.12 | $1.2 \times 10^6$ | 379 |
| PR*12 | PL*8 | 50 | 0.2 | $2.3 \times 10^6$ | 678 |
| | EL*7 | 200 | 0.3 | $1.86 \times 10^6$ | 747 |
| | BM*6 | 1000 | 90 | $4.0 \times 10^6$ | 18974 |

*1: "TH" is the thickness.
*2: "TC" is the thermal conductivity.
*3: "THC" is the thermal capacity.
*4: "TE" is the thermal effusivity.
*5: "FR" is the fixing roller.
*6: "BM" is the base material.
*7: "EL" is the elastic layer.
*8: "PL" is the parting layer.
*9: "T" is the toner.
*10: "RM" is the recording material.
*11: "PA" is the paper.
*12: "PR" is the pressing roller.

A non-steady heat conduction calculation shown in FIG. 4 was performed using the above physical property values in the same heating time (the same nip passing time) as that in the experiment, so that the paper/toner interface temperature immediately after the heating was calculated. On the basis of the model in which the respective members, the paper and the toner are disposed on a one-dimensional plane as shown in (b) of FIG. 3, thermal calculation was made using a one-dimensional equation of non-steady heat conduction, so that the paper/toner interface temperature was calculated in a numerical value experiment.

The above model is a model such that the toner image is fixed on the paper when the paper/toners interface temperature reaches a predetermined temperature depending on the species of the toner, and can be understood as a model close to an actual fixing phenomenon in the fixing device 20.

The anti-wearing property of the fixed image of each of the image samples plotted in FIG. 5 is a remaining rate (%) of the image after the fixed image is rubbed with an abrasive eraser.

The fixed image of the image sample was rubbed with the abrasive eraser by 5 reciprocations, and the rubbed image was observed through a microscope. Then, an area of the fixed toner remaining in a 5 mm-square region was obtained to calculate the remaining rate. In this embodiment, when the image has the remaining rate of 90% or more, the image was evaluated as a satisfactory (acceptable) image.

As shown in FIG. 5, there is a correlation between the paper/toner interface temperature and the fixing property. With respect to the anti-wearing property, a satisfactory (acceptable) level is satisfied at the paper/toner interface temperature of 92° C. or more in the nip N, and in insufficient at the paper/toner interface temperature of less than 92° C.

(Thermal Effusivity of Parting Layer and Elastic Layer)

The thermal effusivity is the physical property value used when heat conduction is calculated when layers different in temperature contact each other. With respect to the parting layer, when the thermal conductivity is $\lambda s$, a density is $\rho s$ and a specific heat at constant volume is Cs, thermal effusivity Bs of the parting layer is defined by the following equation:

$$Bs=(\lambda s\times\rho s\times Cs)^{1/2}.$$

Similarly, with respect to the elastic layer, when the thermal conductivity is $\lambda e$, the density is $\rho e$ and the specific heat at constant volume is Ce, the thermal effusivity Be is defined by the following equation:

$$Be=(\lambda e\times\rho e\times Ce)^{1/2}.$$

As methods for measuring the respective physical property values, each of the thermal conductivity, the density and the specific heat is separately obtained and then the thermal effusivity is calculated from the above equations, or the thermal effusivity is directly measured. As a device for measuring the thermal conductivity, a thermal conductivity measuring device ("ai-Phase M10", manufactured by ai-Phase Co., Ltd.) or a hot disk thermal property measuring device ("TPS1500", manufactured by Kyoto Electronic Manufacturing Co., Ltd.) can be used. In the case where a surface layer member is thin, the surface layer member is stacked in layers and then is subjected to the measurement. In this case, attention is given to see that air does not enter the interface. With respect to the density, Archimedean method can be used, and with respect to the specific heat, a differential scanning calorimeter ("DSC", manufactured by Mettler-Toledo International Inc.) can be used.

Further, by using thermal diffusivity, the thermal effusivity may also be obtained from a relationship of: (thermal effusivity)=(thermal conductivity)/(thermal diffusivity)$^{1/2}$. As a thermal diffusivity measuring device, a laser flash method or the thermal diffusivity measuring device ("ai-Mobile 1u, manufactured by ai-Phase Co., Ltd.) can be used. In the case where each device is used, a sample is cut from the roller correspondingly to a size of a sensor, or a sample for measurement is separately prepared. These devices are capable of measuring the physical properties in a state in which a measuring temperature is increased from room temperature to a temperature used for the fixing.

(Relationship Between Thermal Effusivity of Parting Layer and Minimum Fixing Temperature)

Figure 6:
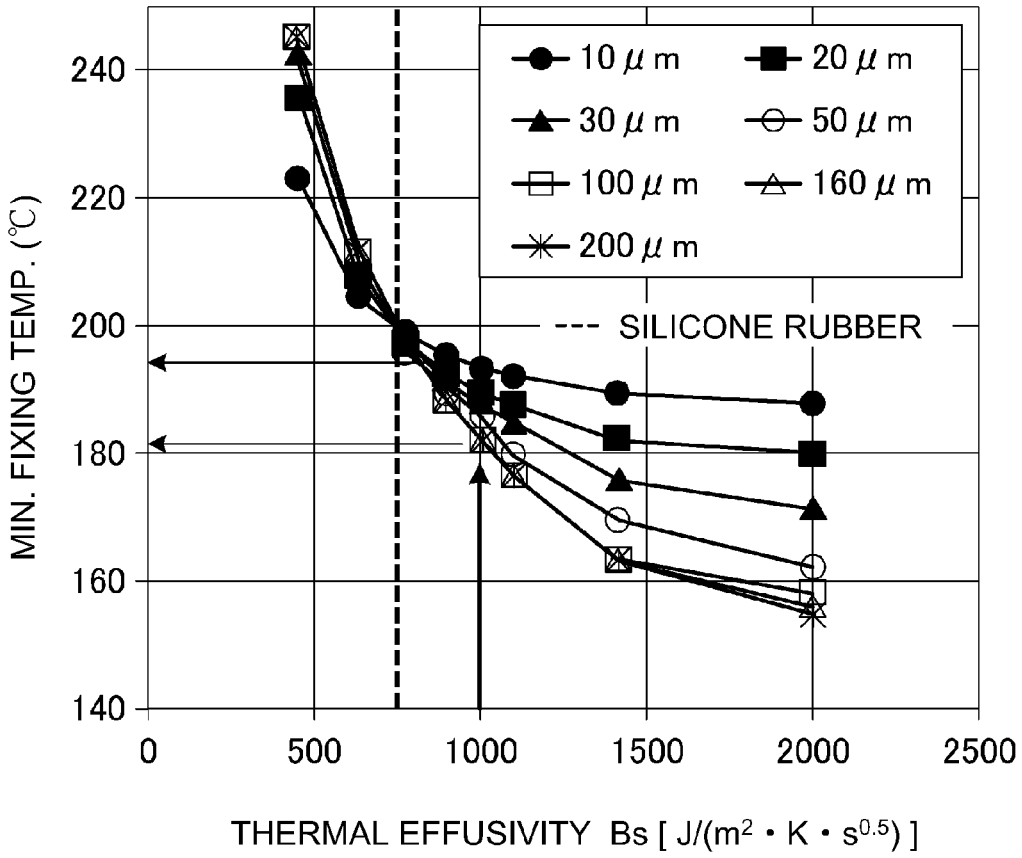
FIG. 6 is an illustration of a relationship thermal effusivity of a parting layer and a minimum fixing temperature.

FIG. 6 is an illustration of a relationship between the thermal effusivity of the parting layer and a minimum fixing temperature. By using the model of (b) of FIG. 3, under an actual image forming condition of the image forming apparatus 100, a temperature adjustment target temperature of the fixing roller 60 for providing the paper/toner interface temperature of 92° C. was calculated by changing a combination of the thermal effusivity Bs and the thickness of the parting layer 61.

As shown in FIG. 4, Th is the temperature adjustment target temperature of the fixing roller 60 where the paper/toner interface temperature increases up to 92° C. at the exit of the nip N of the fixing device 20 to permit evaluation of the anti-wearing property of the fixed image as the satisfactory level. The surface temperature of the fixing roller 60 satisfying a fixing criterion is referred to as the minimum fixing temperature (° C.).

In calculation, a total thickness D which is the sum of a thickness Ds of the parting layer 61 and a thickness De of the elastic layer 62 was set at 250 μm. The thermal effusivity Bs was changed in a range of 447-2000 (J/(m$^2$·K·s$^{0.5}$)), and the thickness Ds was changed in a range of 10 μm-200 μm. The temperature adjustment target temperature of the fixing roller 60 for providing the paper/toner interface temperature of 92° C. in combination of the thermal effusivity Bs and the thickness Ds was calculated. Physical property values of the parting layer of the fixing roller used for calculation are shown in Table 2.

TABLE 2

| MEMBER | | TH*1 [μm] | TC*2 λ [W/mK] | THC*3 ρC [J/m$^2$K] | TE*4 B [J/m$^2$Ks$^{0.5}$] |
|---|---|---|---|---|---|
| FR*5 | PL*6 | 10-200 | 0.1-2 | 2.0 × 10$^6$ | 447-2000 |

*1: "TH" is the thickness.
*2: "TC" is the thermal conductivity.
*3: "THC" is the thermal capacity.
*4: "TE" is the thermal effusivity.
*5: "FR" is the fixing roller.
*6: "PL" is the parting layer.

A result of calculation of the minimum fixing temperature (° C.) obtained, using the model in which the fixing is completed when the paper/toner interface temperature reaches 92° C., in a condition that the thermal effusivity Bs and the thickness Ds of the parting layer 61 are changed is shown in FIG. 6. In FIG. 6, the abscissa represents the thermal effusivity Bs, and the ordinate represents the minimum fixing temperature (° C.). The minimum fixing temperatures (° C.) when the parting layer thickness is changed to 10 μm, 20 μm, 30 μm, 50 μm, 100 μm, 160 μm and 200 μm are shown in FIG. 6. In FIG. 6, a broken line represents thermal effusivity Be of the silicone rubber used in general in the fixing roller.

As shown in FIG. 6, the minimum fixing temperature lowers with an increasing thermal effusivity Bs of the parting layer 61. Under a normal condition that the thermal effusivity Bs of the parting layer 61 is lower than the thermal effusivity Be of the elastic layer 62, with a larger thickness of the parting layer 61, the minimum fixing temperature becomes higher. In order to improve durability, the parting layer 61 is made thick so that the parting layer 61 can be used even when being abraded (worn), but when the parting layer thickness decreases with accumulation of image formation, as shown in FIG. 6, the minimum fixing temperature (° C.) changes.

When the thermal effusivity Bs of the parting layer 61 is made equal to that thermal effusivity Be of the elastic layer 62, even when the thickness of the parting layer 61 is changed, the minimum fixing temperature (° C.) remains unchanged.

(Adjustment of Thermal Effusivity of Parting Layer)

As the material for the parting layer 61, the fluorine-containing resin material having the parting property is used. Particularly, PTFE, PFA or the like may desirably be used. Both of the density ρ and the specific heat of the parting layer 61 are characteristic values of the material used, and do not change largely with respect to the thickness. In the case where the parting layer 61 is the polymeric material, when moleculars are arranged by stretch or the like, there is a tendency that the thermal conductivity λ becomes high with respect to a direction in which the moleculars are arranged.

In the case of the fluorine-containing resin material used for the parting layer 61 of the fixing roller 60, the thermal effusivity Bs measured in the thickness direction is important to let inside heat escape to an outside. Values of the thermal effusivity Bs are as follows.

PTFE: 700 ($J/(m^2 \cdot K \cdot s^{0.5})$) as representative value

PFA: 580 ($J/(m^2 \cdot K \cdot s^{0.5})$) as representative value

In the case where the thermal effusivity Bs of the fluorine-containing resin material is controlled, a heat-conductive filler can be added. As the filler, it is possible to use SiC, ZnO, $Al_2O_3$, AlN, MgO, $SiO_2$, carbon black or the like. In this embodiment, an alumina ($Al_2O_3$) filler is added into the fluorine-containing resin material. In this case, depending on a volume function of the added filler, an entire thermal conductivity λ increases.

However, the $Al_2O_3$ filler is added into the fluorine-containing resin material for the parting layer in the volume function of 30% or more, a parting performance with respect to the melted toner on the surface of the parting layer lowers. Further, hardness of the parting layer increases, and thus followability to the surface of the recording material lowers, so that there is also a liability that the parting layer becomes brittle.

For this reason, it is considered that the limit of an addition amount of the filler into the fluorine-containing resin material for the parting layer is about 30% in terms of the volume function. However, in the case where the $Al_2O_3$ filler is added into the fluorine-containing resin material for the parting layer in the volume function of 30%, it is confirmed empirically that the thermal conductivity of the elastic layer becomes twice.

When the thermal conductivity doubles, assuming that the density ρ and the specific heat c are the same in the thermal effusivity $B=(\Delta.\rho.c)^{1/2}$, the thermal effusivity increases to 1.4 times the original value at lowest. The thermal effusivity of the PFA is 580 ($J/(m^2 \cdot K \cdot s^{0.5})$) as representative value, and when the thermal effusivity value becomes 1.4 times the representative value, the resultant thermal effusivity is 819 ($J/(m^2 \cdot K \cdot s^{0.5})$).

This value exceeds the thermal effusivity B (=747 ($J/(m^2 \cdot K \cdot s^{0.5})$)) of the silicone rubber. That is, by using the $Al_2O_3$ filler, it is possible to adjust the values of the silicone rubber and the parting layer at the same value without lowering the parting property of the parting layer. Therefore, in First Embodiment, the $Al_2O_3$ filler was added in the volume function of 23%, so that the thermal effusivity Be=820 (($J/(m^2 \cdot K \cdot s^{0.5})$) and the thermal effusivity Bs of the parting layer were adjusted so as to be substantially the same value.

(Numerical Value Range of Thermal Effusivity)

Figure 7:
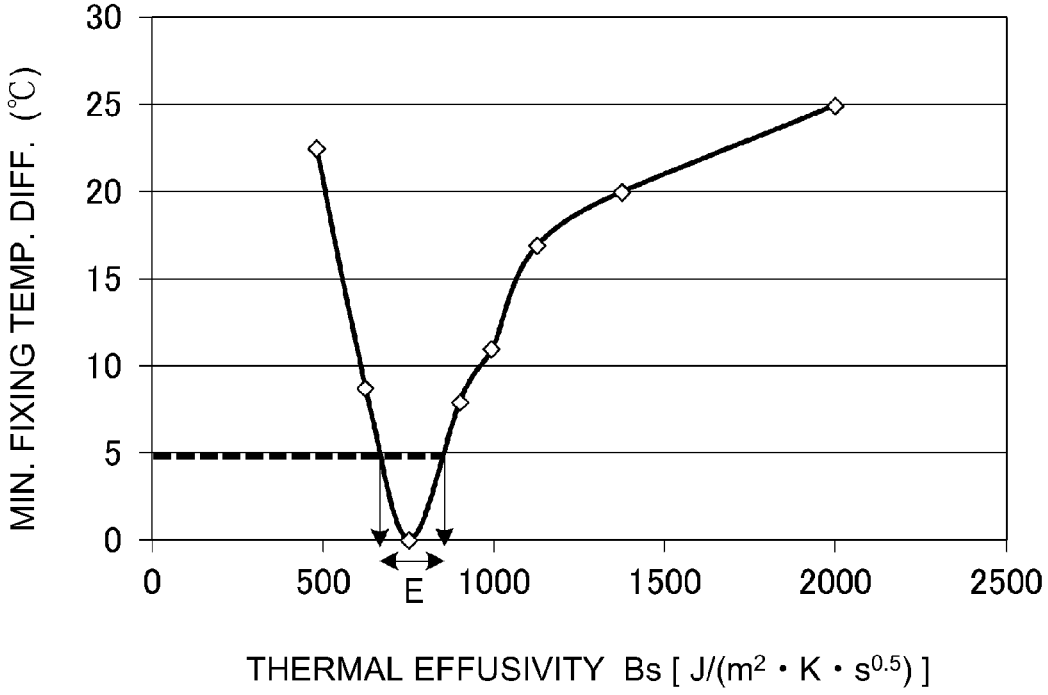
FIG. 7 is an illustration of a relationship between thermal effusivity of the parting layer and a minimum fixing temperature difference.

FIG. 7 is an illustration of a relationship between the thermal effusivity and the minimum fixing temperature of the parting layer. As shown in FIG. 7, by changing the thickness of the parting layer 61, a minimum fixing temperature difference ΔTm changes.

The minimum fixing temperature difference ΔTm is, as shown in FIG. 6, a difference between the minimum fixing temperature Tm for the parting layer thickness of 10 μm and the minimum fixing temperature Tm for the parting layer thickness of 200 μm when the thermal effusivity Bs of the parting layer 61 is constant.

For example, as shown in FIG. 6, in the case where the thermal effusivity Bs of the parting layer 61 is 1000 ($J/(m^2 \cdot K \cdot s^{0.5})$), the minimum fixing temperature for the thickness of 10 μm is 193° C. and the minimum fixing temperature for the thickness of 200 μm is 182° C., and therefore the minimum fixing temperature difference ΔTm is 11° C.

The minimum fixing temperature difference ΔTm corresponds to a fluctuation range of the paper/toner interface temperature when a variation in thickness of the parting layer 61 generates due to abrasion or a manufacturing error. For this reason, it is desirable that the fluctuation range of the minimum fixing temperature difference ΔTm is small, and the fluctuation range of the minimum fixing temperature difference ΔTm may desirably be within 5° C. This is because when the minimum fixing temperature difference ΔTm is 5° C. or more, a difference is glossiness of the fixed image generates, and in the case of a color toner, improper color mixing generates.

As shown in FIG. 7, as the thermal effusivity Bs of the parting layer 61 approaches the thermal effusivity Be of the elastic layer 62, the minimum fixing temperature difference ΔTm changing depending on the thickness of the parting layer 61 becomes smaller. In the case where a range of ±5° C. of the minimum fixing temperature difference ΔTm is set at an allowable range of the uneven glossiness, the thermal effusivity of the parting layer 61 may only be required to fall within the range of ±5% in which the thermal effusivity Be of the elastic layer 62 is the center. Accordingly, when a range E indicated by a double-pointed arrow in FIG. 7 is expressed as a mathematical formula, the following formula is given.

$$-4<(Be-Bs)/Be\times 100<4$$

(Relationship of Be=Bs)

In First Embodiment, the thermal effusivity Be of the elastic layer 62 and the thermal effusivity Bs of the parting layer 61 were set at the same value. on the basis of such a concept, by using the model of (b) of FIG. 3, under the actual image forming condition of the image forming apparatus 100, the temperature adjustment target temperature of the fixing roller 60 for providing the paper/toner interface temperature of 92° C. was calculated. A calculation result is shown in Table 3.

TABLE 3

| EMB. | TH*1 [μm] | TE*2 B [$J/(m^2Ks^{0.5})$] | MFT*3 [° C.] |
|---|---|---|---|
| COMP.EX 1 | 15 | 630 | 162 |
| COMP.EX 2 | 30 | 630 | 172 |
| EMB. 1 | 15 | 750 | 164 |
| EMB. 2 | 30 | 750 | 164 |

*1: "TH is the thickness.
*2: "TE" is the thermal effusivity.
*3: "MFT" is the minimum fixing temperature As shown in Table 3, in Comparison Examples 1 and 2, the thermal effusivity Bs of the parting layer 61 and the thermal effusivity Be of the elastic layer 62 are different by 16%, and therefore the minimum fixing temperature difference ΔTm between Comparison Example 1 in which the thickness of the parting layer 61 is 15 μm and Comparison Example 2 in which the thickness of the parting layer 61 is 30 μm considerably exceeds 5° C. In Comparison Example 1 in which the thickness of the parting layer 61 is 15 μm, the minimum fixing temperature Tm is 162° C., and on the other hand, in Comparison Example 2 in which the thickness of the parting layer 61 is 30 μm, the minimum fixing temperature Tm is 172° C. For this reason, when the thickness of the parting layer is partly abraded to 15 μm by accumulation of image formation using the fixing roller 60 in which the thickness of the parting layer 61 is 30 μm, a large temperature non-uniformity generates on the surface of the fixing roller 60, so that the uneven glossiness of the fixed image becomes conspicuous. When partial abrasion of the parting layer 61 generates, partial unevenness of glossiness and partial improper color mixing generate on a print after the fixing.

On the other hand, in Embodiments 1 and 2, the thermal effusivity Bs of the parting layer 61 and the thermal effusivity Be of the elastic layer 62 are set at the same value, and therefore also the minimum fixing temperature difference ΔTm between Embodiment 1 in which the thickness of the parting layer 61 is 15 μm and Embodiment 2 in which the thickness of the parting layer 61 is 30 μm are the same. The minimum fixing temperature Tm was the certain value independently of the thickness of the parting layer 61. For this reason, even when the thickness of the parting layer is partly abraded to 15 μm by accumulation of image formation using the fixing roller 60 in which the thickness of the parting layer 61 is 30 μm, substantially no temperature non-uniformity generates on the surface of the fixing roller 60, so that the fixed image having uniform glossiness can be obtained.

As described above, in FIG. 3, the fixing roller 60 heats the toner image in contact with the toner image-formed surface of the recording material on which the toner image is carried. The fixing roller 60 is a heating roller in which an opposite surface of the elastic layer 62 to the parting layer 61 is bonded to a cylindrical metal member (metal layer).

On the other hand, the parting layer 61 is formed of the material in which the filler having the thermal conductivity higher than that of the fluorine-containing resin material is dispersed into the fluorine-containing resin material. The parting layer 61 contacts the toner image-formed surface of the recording material. The elastic layer 62 is formed of the material in which the filler having the thermal conductivity higher than that of the rubber material is dispersed into the rubber material. The elastic layer 62 is bonded in a side opposite from the surface of the parting layer 61 contacting the toner image-formed surface of the recording material, and is heated through the surface opposite from the surface bonded to the parting layer 61.

Effect of First Embodiment

In First Embodiment, when the thermal effusivity of the parting layer 61 is Bs, and the thermal effusivity of the elastic layer 62 is Be, Be=Bs, i.e., $-0.04<(Be-Bs)/Be<0.04$ is satisfied. For this reason, even when a variation in thickness of the parting layer for each of places at the surface of the fixing roller becomes large with accumulation of the image formation, a variation in fixing property is suppressed at the entire surface, so that the uneven glossiness and a partial lowering in image intensity do not readily generate.

That is, in view of the change in thickness of the outermost layer generated due to the manufacturing step or durable deterioration during use, the parting layer 61 of the fixing roller 60 is designed so that the thickness thereof is increased to some extent. In First Embodiment, the thermal effusivity of the elastic layer 62 and the thermal effusivity of the parting layer 61 are made equal to each other, and therefore even when an allowable value of the thickness is not set, the surface temperature of the fixing roller 60 is not so changed, and thus improper fixing does not readily generate.

In First Embodiment, even when the thickness non-uniformity of the parting layer 61 generates, the fixing temperature of the image can be made constant as a whole, and therefore there is an effect of having a latitude in designing the parting layer. Even when the thickness of the parting layer 61 decreases by abrasion of the parting layer 61 during use or change by tension, the fixing temperature is not required to be changed.

In First Embodiment, a problem such that the fixing temperature of the image for each of places varies depending on the difference in thermal conductivity between the parting layer 61 and the elastic layer 62 is solved, and therefore energy-saving fixing at high speed can be carried out.

Modified Embodiment 1

As shown in (a) of FIG. 3, the silicone rubber of the elastic layer 62 needs to have a high heat-conductive property, in addition to softness, in order to conduct heat from an inside heat source to an outside. For that reason, into the silicone rubber, as the filler, SiC, ZnO, $Al_2O_3$, AlN, MgO, $SiO_2$, carbon black or the like is added. These substances may also be added in mixture of several species.

However, the filler in the elastic layer 62 has the thermal conductivity which is several times to several tens of times the thermal conductivity of the silicone rubber, and therefore in some cases, the uneven glossiness is caused on the toner after the fixing. In order to solve this problem, the uneven glossiness may also be suppressed by providing a density distribution in the thickness direction to lower the thermal conductivity in a shallow region of the elastic layer 62 in the parting layer 61 side.

In order to enhance the thermal conductivity by increasing the thermal effusivity Be, the heat-conductive filler may also be added into the silicone rubber for the elastic layer 62. By adding the filler, the density ρ and the thermal conductivity become high, with the result that the thermal effusivity Be becomes high. In this case, with respect to the parting layer 61, it is desirable that the thermal effusivity Bs is further enhanced by adjusting the species and content of the filler so as to coincide with the thermal effusivity Be of the elastic layer 62.

Modified Embodiment 2

Figure 8:
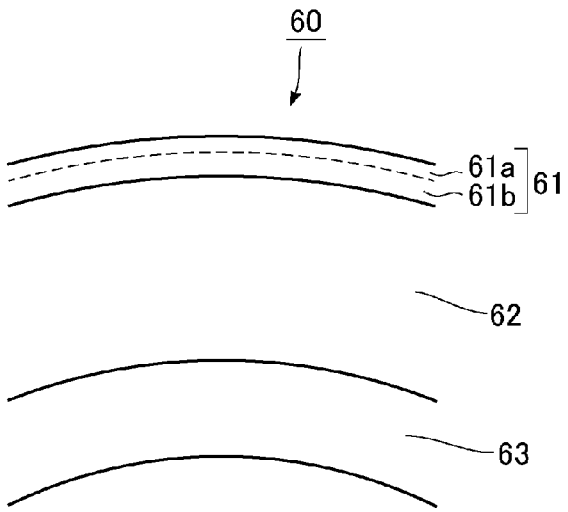
FIG. 8 is an illustration of a structure of a fixing roller in Modified Embodiment 2.

FIG. 8 is an illustration of a structure of a fixing roller in Modified Embodiment 2. As shown in FIG. 8, in the case where the thermal effusivity Bs is controlled by adding the filler into the fluorine-containing resin material used for the parting layer 61, when the addition amount of the filler is increased, there is a possibility that the parting property with respect to the melted toner on the surface of the parting layer 61 lowers. In this case, it is possible to use a law such that repellency on the surface of a substance is determined by a property in a range of several 10 nm from a material surface.

That is, the surface layer in the range of several 10 nm from the surface of the parting layer 61 is constituted as a first parting layer 61*a* formed only of the fluorine-containing resin material containing no filler, and under the first parting layer 61*a*, a second parting layer 61*b* formed of the fluorine-containing resin material in which the filler contained at a high density (concentration) is provided. When the thickness is several 10 nm, this thickness is negligible in terms of heat transfer resistance, and therefore it becomes possible to compatibly realize the parting property and the heat-conductive property of the parting layer 61.

As described above, in Modified Embodiment 2, the parting layer 61 includes the first parting layer 61*a* contacting the toner image-formed surface of the recording material and the second parting layer 61*b* which is bonded to the first parting layer 61*a* and which is heated through a surface opposite from the surface bonded to the first parting layer 61*a*. When the thickness of the first parting layer 61*a* is t1, the thickness of the second parting layer 61*b* is t2, the thermal effusivity of the first parting layer 61*a* is Bs1, and the thermal effusivity of the second parting layer 61*b* is Bs2, the following relationships are satisfied:

$$T1<T2 \text{ and } Bs1<Bs2.$$

Further, the following relationship is also satisfied:

$$Bs-Bs1>Bs2-Bs$$

Second Embodiment

Figure 9:
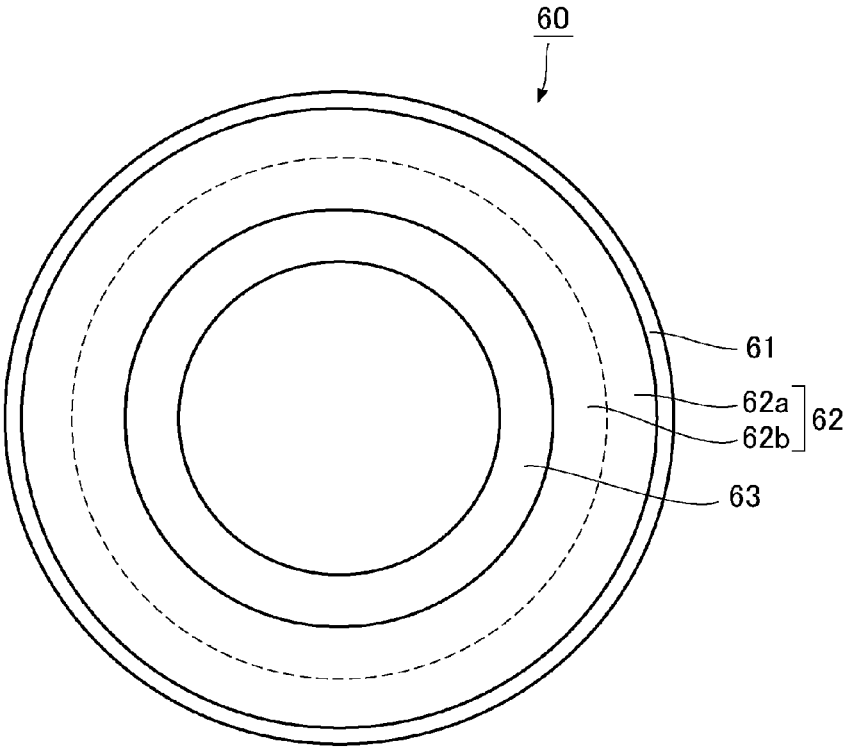
FIG. 9 is an illustration of a structure of a fixing roller in Embodiment 2.
Figure 10:
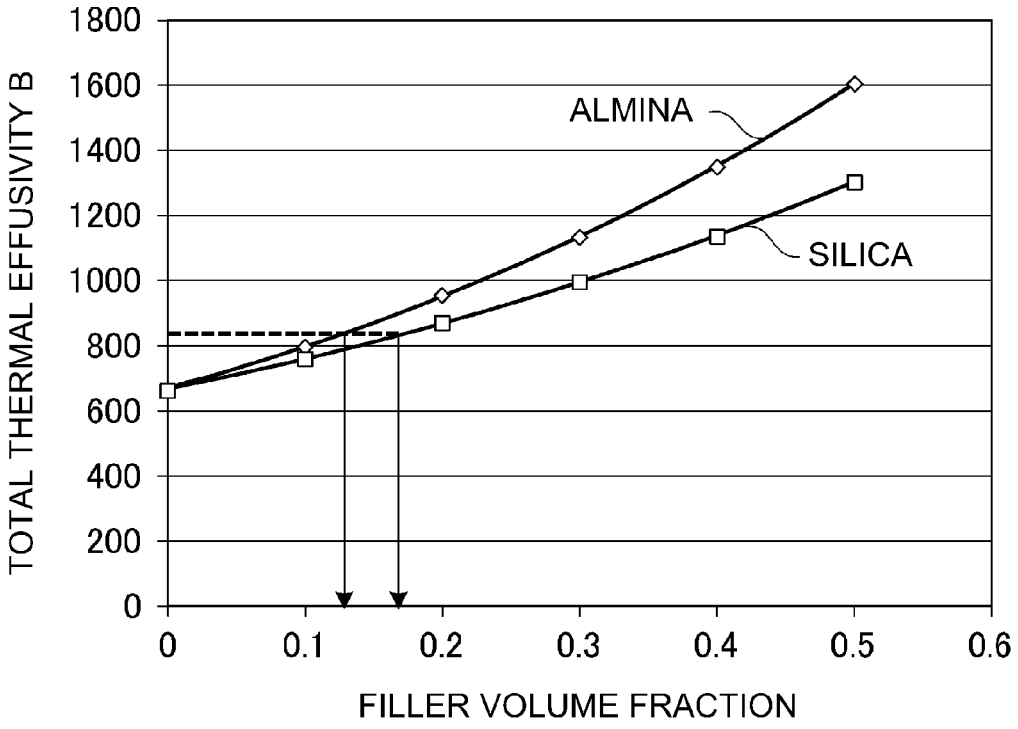
FIG. 10 is an illustration of a difference in this embodiment depending on a species of a filler.

FIG. 9 is an illustration of a structure of a fixing roller in Second Embodiment. FIG. 10 is an illustration of a difference in this embodiment depending on the species of the filler.

In First Embodiment, the two-layer structure consisting of the parting layer 61 and the elastic layer 62 of the fixing roller 60 was described, but the present invention can be carried out also in the case where the elastic layer 62 is constituted by a plurality of layers different in thermal property.

As shown in FIG. 9, the elastic layer 62 of the fixing roller 60 includes a plurality of layers i (=1, 2, 3 . . . n) different in thermal conductivity λi, density ρi and specific heat ci. The elastic layer 62 is constituted by the plurality of layers i in order to adjust elasticity of the elastic layer 62 as a whole.

In order to equalize the thermal effusivity Bi of the respective layers i, two species of the fillers can be added to each of the layers i of the elastic layer 62. In each layer i, by adjusting distribution amounts of the two species of the fillers, it is possible to obtain desired elasticity of the fixing roller 60 as a whole while equalizing the thermal effusivity Bi of the respective layers i.

The case where two or more species of the fillers are stepwisely added into each of the layers i of the elastic layer 62 will be considered. According to the above-described "Thermal Conductivity of Polymeric Material" of Electrotechnical Laboratory Investigation Report, the Rayleigh-Maxwell expression is introduced as a thermal conductivity prediction expression of a polymeric material layer in which the filler is dispersed.

$$\lambda i = \frac{2\lambda r + \lambda f - 2v(\lambda r - \lambda f)}{2\lambda r + \lambda f + v(\lambda r - \lambda f)} \cdot \lambda r$$

Here, specific heat capacity (ρc) can be expressed by the following equation using a volume function v in accordance with the law of conservation of mass.

$$\rho ici = v\rho f \cdot cf + (1-v)\rho r \cdot cr$$

Therefore, the thermal effusivity Bi of each of the layers i of the composite elastic layer can be expressed by the following equation.

$$Bi = \sqrt{\left[\frac{2\lambda r + \lambda f - 2v(\lambda r - \lambda f)}{2\lambda r + \lambda f + v(\lambda r - \lambda f)} \cdot \lambda r\right] \cdot [v\rho f \cdot cf + (1-v)\rho r \cdot cr]}$$

In the above equations, meanings of the respective symbols are as follows:

Bi: (thermal effusivity)=$(\lambda i \cdot \rho i \cdot ci)^{1/2}$

λi: thermal conductivity (r: rubber, f: filler)

ρi: density (r: rubber, f: filler)

ci: specific heat (r: rubber, f: filler)

v: volume function of filler

Representative physical property values of alumina, silica and the silicone rubber are shown in Table 4.

TABLE 4

| MATERIAL | TC*1 λ [W/mK] | THC*2 ρC [J/m²K] | TE*3 B [J/(m²Ks^0.5)] |
|---|---|---|---|
| ALUMINA | 36 | $3.03 \times 10^6$ | 10444 |
| SILICA | 6.2 | $1.98 \times 10^6$ | 3506 |
| SILICONE RUBBER | 0.3 | $1.46 \times 10^6$ | 662 |

*1: "TC" is the thermal conductivity.
*2: "THC" is the thermal capacity.
*3: "TE" is the thermal effusivity.

The relationship between the thermal effusivity and the volume function when the filler is added into the silicone rubber is shown in FIG. 10 on the basis of the physical property values in Table 4 and the above-described equation for the thermal effusivity Bi.

As shown in FIG. 9, in Second Embodiment, the elastic layer 62 is constituted by the first elastic layer 62*a* (i=1) and the second elastic layer 62*b* (i=2). Further, into each of the first elastic layer 62*a* and the second elastic layer 62*b*, the two species of the fillers consisting of alumina ($Al_2O_3$) and silica ($SiO_2$) are dispersed to enhance the thermal effusivity. In this case, when an addition amount of each of the fillers is controlled, it is possible to equalize the thermal effusivity of both layers.

As shown in FIG. 10, the relationship between the filler volume function and the thermal effusivity B are different between alumina ($Al_2O_3$) and silica ($SiO_2$). For example, the thermal effusivity Bs of the parting layer is set at 820 (J/(m²·K·s^0.5)) described above. In this case, when the fillers are added into the elastic layer 62 consisting of the plurality of layers in such a manner that the volume function of alumina is 0.13 (13 vol. %) and the volume function of silica is 0.17 (17 vol. %), the thermal effusivity of each of the plurality of layers of the elastic layer 62 can be set at the same value of 820 (J/(m²·K·s^0.5)).

As described above, even in the case where the elastic layer 62 is constituted by the plurality of layers. In Second Embodiment, the elastic layer 62 includes the first elastic layer 62*a* bonded to the parting layer 61 and the second elastic layer 62*b* bonded to the first elastic layer 61*a* and heated through a surface opposite from the surface bonded to the first elastic layer 61*a*. When the thermal effusivity of the first elastic layer 62*a* is Be1 and the thermal effusivity of the second elastic layer 62*b* is Be2, Be2 nearly equals to Be1.

In First and Second Embodiments described above, the present invention can be carried out also in other embodiments in which a part or all of constitutions in First and Second Embodiments are replaced with alternative constitutions thereof so long as the thermal effusivity is set at the substantially same value for each of the surface layer and the elastic layer of the rotatable heating member.

Accordingly, with respect to dimensions, materials, shapes, relative arrangements of constituent elements described in First and Second Embodiments, the scope of the present invention is not intended to be limited thereto unless otherwise particularly specified.

Figure 11:
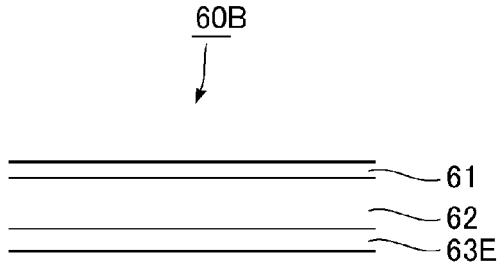
FIG. 11 is an illustration of a heating belt in another embodiment.

In First and Second Embodiments, the fixing roller was principally described, but the present invention is applicable to also the fixing belt. As shown in FIG. 11, a fixing belt 60E which is the rotatable heating member is a heating belt including the parting layer 61, the elastic layer 62 and an endless belt base material (metal layer) 63E bonded to the elastic layer 62 at an interface opposite from an interface between the parting layer 61 and the elastic layer 62.

In First and Second Embodiments, the halogen lamp is employed as the heat source, but another constitution may also be applicable if the constitution includes a heat generation portion inside the elastic layer. For example, the present invention is applicable to also a belt fixing device using a ceramic heater and a fixing device in which the metal layer to be heated through electromagnetic induction heating by an IH heating method is provided under the elastic layer. In this case, the present invention is carried out by replacing the heating member (halogen heater) 65 in First and Second Embodiments with a heating mechanism of an electromagnetic induction heating type. The present invention is applicable to not only a fixing device of a contact type in which the roller member or the belt member is contacted to the (unfixed) toner image to thermally deform the toner thereby to fix the toner image, but also an image heating apparatus for heating a partly fixed image or a fixed image.

The present invention can be carried out also in other image forming apparatuses for various uses, such as a printer, a copying machine, a facsimile machine, and a multi-function machine.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 010907/2014 filed Jan. 24, 2014, which is hereby incorporated by reference.

What is claimed is:

1. A rotatable heating member incorporating a heat source configured to heat a toner image on a sheet, comprising:

an elastic layer; and a surface layer provided on the elastic layer, wherein when thermal effusivity of the surface layer is Bs and thermal effusivity of the elastic layer is Be, $-0.04<(Be-Bs)/Be<0.04$.

2. The rotatable heating member according to claim 1, wherein the surface layer is formed of a fluorine-containing resin material, and the elastic layer is formed of a rubber.

3. The rotatable heating member according to claim 2, wherein a heat-conductive filler is dispersed in the fluorine-containing resin material and the rubber.

4. The rotatable heating member according to claim 1, wherein the surface layer includes a lower layer in which a heat-conductive filler is dispersed and an upper layer provided on the lower layer and in which the heat-conductive filler is not dispersed, and wherein when a thickness of the upper layer is $t_1$, a thickness of the lower layer is $t_2$, thermal effusivity of the upper layer is $Bs_1$, and thermal effusivity of the lower layer is $Bs_2$, $t_1<t_2$ and $Bs_1<Bs<Bs_2$.

5. The rotatable heating member according to claim 1, wherein Be=Bs.

6. The rotatable heating member according to claim 1, further comprising a base layer, wherein the elastic layer is provided on the base layer.

7. A rotatable heating member incorporating a heat source configured to heat a toner image on a sheet, comprising:

a metal layer to be heated through electromagnetic induction heating;

an elastic layer provided on the layer; and a surface layer provided on the elastic layer, wherein when thermal effusivity of the surface layer is Bs and thermal effusivity of the elastic layer is Be, $-0.04<(Be-Bs)/Be<0.04$.

8. The rotatable heating member according to claim 7, wherein the surface layer is formed of a fluorine-containing resin material, and the elastic layer is formed of a rubber.

9. The rotatable heating member according to claim 8, wherein a heat-conductive filler is dispersed in the fluorine-containing resin material.

10. The rotatable heating member according to claim 8, wherein a heat-conductive filler is dispersed in the rubber.

11. The rotatable heating member according to claim 8, wherein a heat-conductive filler is dispersed in the fluorine-containing resin material and the rubber.

12. The rotatable heating member according to claim 7, wherein the surface layer includes a lower layer in which a heat-conductive filler is dispersed and an upper layer provided on the lower layer and in which the heat-conductive filler is not dispersed, and wherein when a thickness of the upper layer is $t_1$, a thickness of the lower layer is $t_2$, thermal effusivity of the upper layer is $Bs_1$, and thermal effusivity of the lower layer is $Bs_2$, $t_1<t_2$ and $Bs_1<Bs<Bs_2$.

13. The rotatable heating member according to claim 7, wherein Be=Bs.

14. An image heating apparatus comprising:

a rotatable heating member configured to heat a toner image on a sheet, the rotatable heating member including an elastic layer and a surface layer provided on the elastic layer; and a heating mechanism configured to heat the rotatable heating member from an inside of the rotatable heating member, wherein when thermal effusivity of the surface layer is Bs and thermal effusivity of the elastic layer is Be, $-0.04<(Be-Bs)/Be<0.04$.

15. An image heating apparatus comprising:

a rotatable heating member configured to heat a toner image on a sheet, the rotatable heating member including a metal layer, an elastic layer provided on the metal layer, and a surface layer provided on the elastic layer; and a heating mechanism configured to heat the metal layer through electromagnetic induction heating, wherein when thermal effusivity of the surface layer is Bs and thermal effusivity of the elastic layer is Be, $-0.04<(Be-Bs)/Be<0.04$.

* * * * *